US006347463B1

(12) United States Patent
Novak

(10) Patent No.: US 6,347,463 B1
(45) Date of Patent: Feb. 19, 2002

(54) PAINT APPLICATOR CLEANING APPARATUS

(76) Inventor: Larry A. W. Novak, 36790 Harper Ave. Apt. 202, Clinton, MI (US) 48035

( * ) Notice: Subject to any disclaimer, the term of this patent is extended or adjusted under 35 U.S.C. 154(b) by 0 days.

(21) Appl. No.: 09/765,471

(22) Filed: Jan. 22, 2001

(51) Int. Cl.[7] ..... F26B 17/24; F26B 17/30
(52) U.S. Cl. ..... 34/59; 34/328
(58) Field of Search ..... 34/58, 312, 328; 134/149

(56) References Cited

U.S. PATENT DOCUMENTS 5,185,938 A * 2/1993 Hutt ..... 34/58
5,473,823 A * 12/1995 Powell ..... 34/58
6,012,473 A * 1/2000 Koyama ..... 134/149
6,038,787 A * 3/2000 Dean et al. ..... 34/312
6,088,933 A * 7/2000 Mallalieu ..... 34/328
6,115,935 A * 9/2000 Collins et al. ..... 34/58

* cited by examiner

*Primary Examiner*—Teresa Walberg
*Assistant Examiner*—L Fastovsky

(57) ABSTRACT

A paint applicator cleaning apparatus for allowing a user to easily clean painting tools such as slim jim sleeves, brushes and roller skins. The paint applicator cleaning apparatus includes a housing, which includes an outer shaft and an inner shaft. The inner shaft is rotatably coupled to the outer shaft, the outer shaft is designed for being gripped by a user. A drive assembly is slidably inserted through the inner shaft of the housing such that longitudinal movement of the drive assembly rotates the inner shaft. The drive assembly includes a handle that extends from the housing. The handle is designed for facilitating gripping of the drive assembly by a hand of the user. A first adapter assembly is slidably coupled to the inner shaft of the housing, the first adapter is designed for removably receiving a elongated roller cover. The first adapter assembly is rotated when the inner shaft is rotated by the drive assembly whereby the elongated roller cover is spun and the water is forced out the elongated roller cover.

14 Claims, 7 Drawing Sheets

52
24
38

PAINT APPLICATOR CLEANING APPARATUS

BACKGROUND OF THE INVENTION

1. Field of the Invention

The present invention relates to paint applicator cleaning apparatuses and more particularly pertains to a new paint applicator cleaning apparatus for allowing a user to easily clean painting tools such as slim jim sleaves, brushes and roller skins.

2. Description of the Prior Art

The use of paint applicator cleaning apparatuses is known in the prior art. More specifically, paint applicator cleaning apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,884,709; 5,630,284; 5,937,534; 5,588,221; 5,873,176; and U.S. Pat. No. Des. 117,457.

While these devices fulfill their respective, particular objectives and requirements, the aforementioned patents do not disclose a new paint applicator cleaning apparatus. The inventive device includes a housing, which includes an outer shaft and an inner shaft. The inner shaft is rotatably coupled to the outer shaft, the outer shaft is designed for being gripped by a user. A drive assembly is slidably inserted through the inner shaft of the housing such that longitudinal movement of the drive assembly rotates the inner shaft. The drive assembly includes a handle that extends from the housing. The handle is designed for facilitating gripping of the drive assembly by a hand of the user. A first adapter assembly is slidably coupled to the inner shaft of the housing, the first adapter is designed for removably receiving a elongated roller cover. The first adapter assembly is rotated when the inner shaft is rotated by the drive assembly whereby the elongated roller cover is spun and the water is forced out the elongated roller cover.

In these respects, the paint applicator cleaning apparatus according to the present invention substantially departs from the conventional concepts and designs of the prior art, and in so doing provides an apparatus primarily developed for the purpose of allowing a user to easily clean painting tools such as slim jim sleeves, brushes and roller skins.

SUMMARY OF THE INVENTION

In view of the foregoing disadvantages inherent in the known types of paint applicator cleaning apparatuses now present in the prior art, the present invention provides a new paint applicator cleaning apparatus construction wherein the same can be utilized for allowing a user to easily clean painting tools such as slim jim sleeves, brushes and roller skins.

The general purpose of the present invention, which will be described subsequently in greater detail, is to provide a new paint applicator cleaning apparatus apparatus and method which has many of the advantages of the paint applicator cleaning apparatuses mentioned heretofore and many novel features that result in a new paint applicator cleaning apparatus which is not anticipated, rendered obvious, suggested, or even implied by any of the prior art paint applicator cleaning apparatuses, either alone or in any combination thereof.

To attain this, the present invention generally comprises a housing, which includes an outer shaft and an inner shaft. The inner shaft is rotatably coupled to the outer shaft, the outer shaft is designed for being gripped by a user. A drive assembly is slidably inserted through the inner shaft of the housing such that longitudinal movement of the drive assembly rotates the inner shaft. The drive assembly includes a handle that extends from the housing. The handle is designed for facilitating gripping of the drive assembly by a hand of the user. A first adapter assembly is slidably coupled to the inner shaft of the housing, the first adapter is designed for removably receiving a elongated roller cover. The first adapter assembly is rotated when the inner shaft is rotated by the drive assembly whereby the elongated roller cover is spun and the water is forced out the elongated roller cover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new paint applicator cleaning apparatus apparatus and method which has many of the advantages of the paint applicator cleaning apparatuses mentioned heretofore and many novel features that result in a new paint applicator cleaning apparatus which is not anticipated, rendered obvious, suggested, or even implied by any of the prior art paint applicator cleaning apparatuses, either alone or in any combination thereof.

It is another object of the present invention to provide a new paint applicator cleaning apparatus, which may be easily and efficiently manufactured and marketed.

It is a further object of the present invention to provide a new paint applicator cleaning apparatus, which is of a durable and reliable construction.

An even further object of the present invention is to provide a new paint applicator cleaning apparatus which is susceptible of a low cost of manufacture with regard to both materials and labor, and which accordingly is then susceptible of low prices of sale to the consuming public, thereby making such paint applicator cleaning apparatus economically available to the buying public.

Still yet another object of the present invention is to provide a new paint applicator cleaning apparatus which provides in the apparatuses and methods of the prior art some of the advantages thereof, while simultaneously overcoming some of the disadvantages normally associated therewith.

Still another object of the present invention is to provide a new paint applicator cleaning apparatus for allowing a user to easily clean painting tools such as slim jim sleeves, brushes and roller skins.

Yet another object of the present invention is to provide a new paint applicator cleaning apparatus which includes a housing which includes an outer shaft and an inner shaft. The inner shaft is rotatably coupled to the outer shaft, the outer shaft is designed for being gripped by a user. A drive assembly is slidably inserted through the inner shaft of the housing such that longitudinal movement of the drive assembly rotates the inner shaft. The drive assembly includes a handle that extends from the housing. The handle is designed for facilitating gripping of the drive assembly by a hand of the user. A first adapter assembly is slidably coupled to the inner shaft of the housing, the first adapter is designed for removably receiving a elongated roller cover. The first adapter assembly is rotated when the inner shaft is rotated by the drive assembly whereby the elongated roller cover is spun and the water is forced out the elongated roller cover.

Still yet another object of the present invention is to provide a new paint applicator cleaning apparatus that allows a user to user one device to clean brushes, rollers, slim jims and skin sleeves quickly and completely.

Even still another object of the present invention is to provide a new paint applicator cleaning apparatus will save the user money by not having to replace brushes and other painting tools as often.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
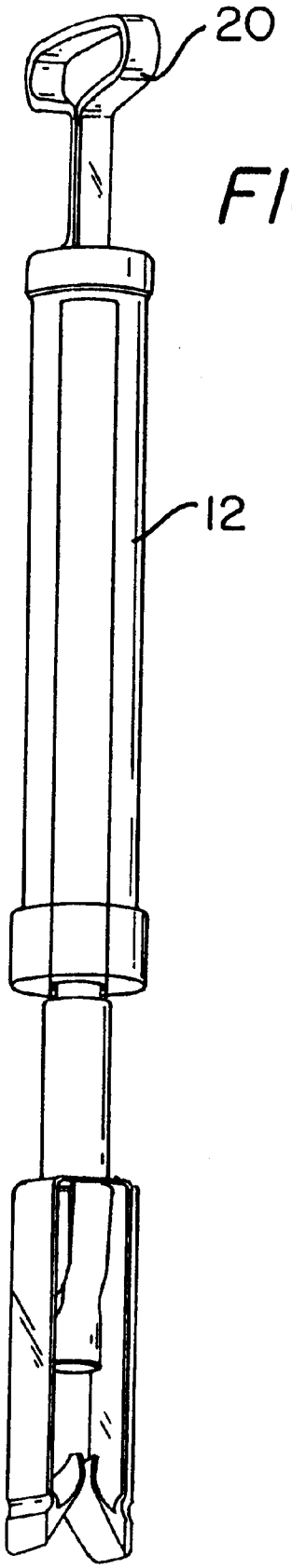
FIG. 1 is a perspective view of a new paint applicator cleaning apparatus according to the present invention.
Figure 2:
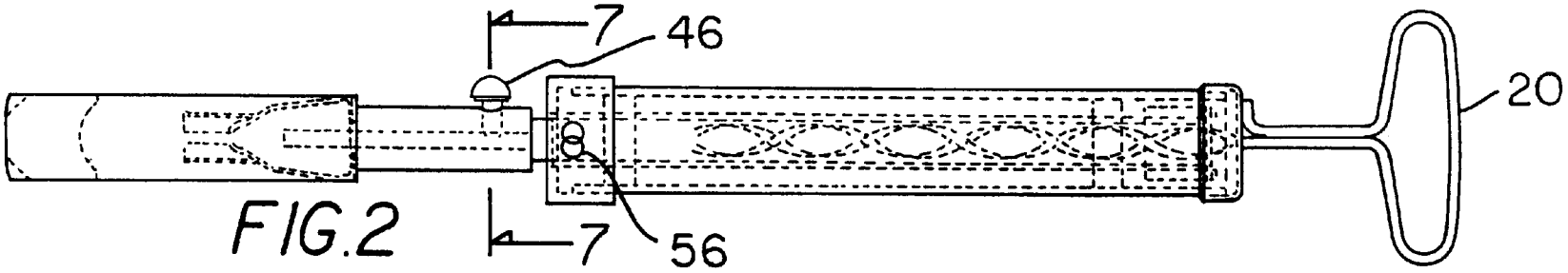
FIG. 2 is a side view of the present invention.
Figure 3:
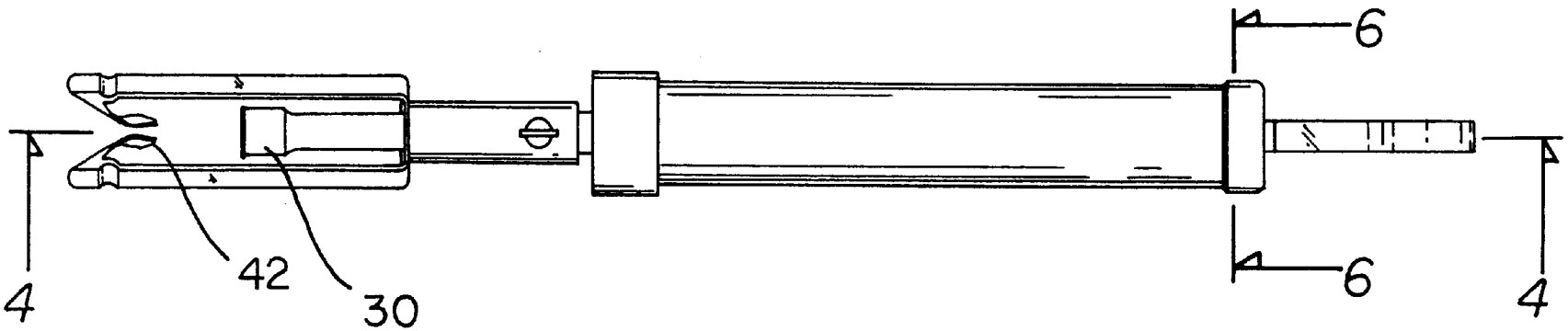
FIG. 3 is a side view of the present invention.
Figure 4:
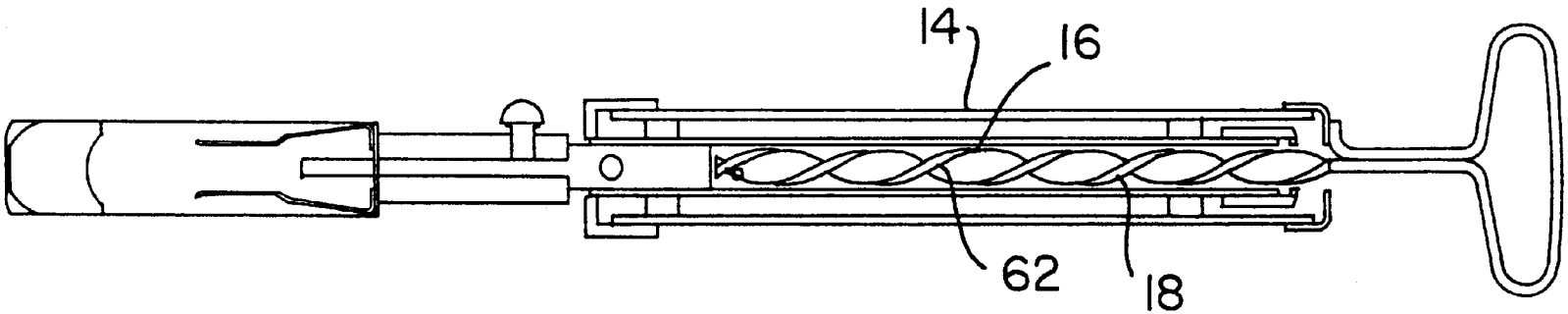
FIG. 4 is a cut away view of the present invention.
Figure 7:
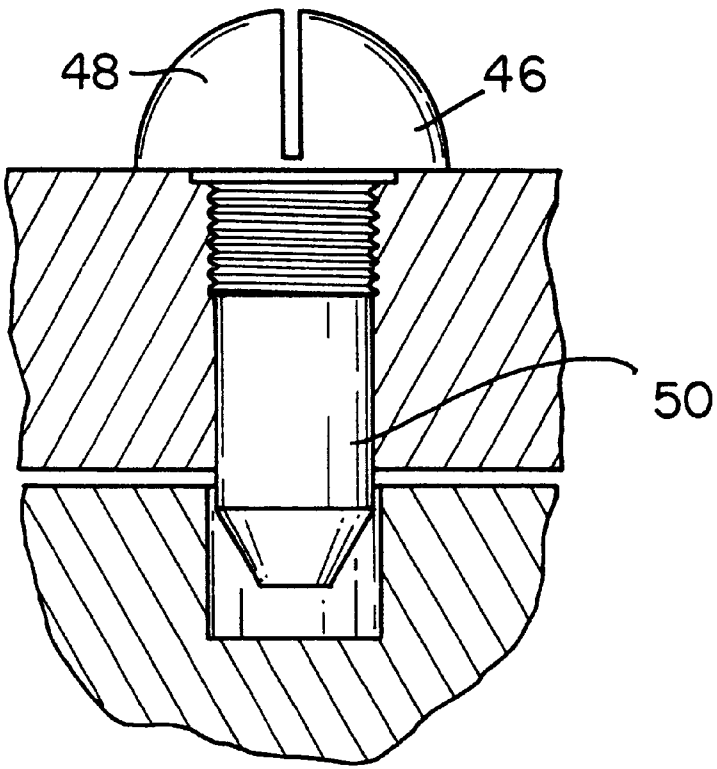
FIG. 7 is a cut away of the present invention.
Figure 5:
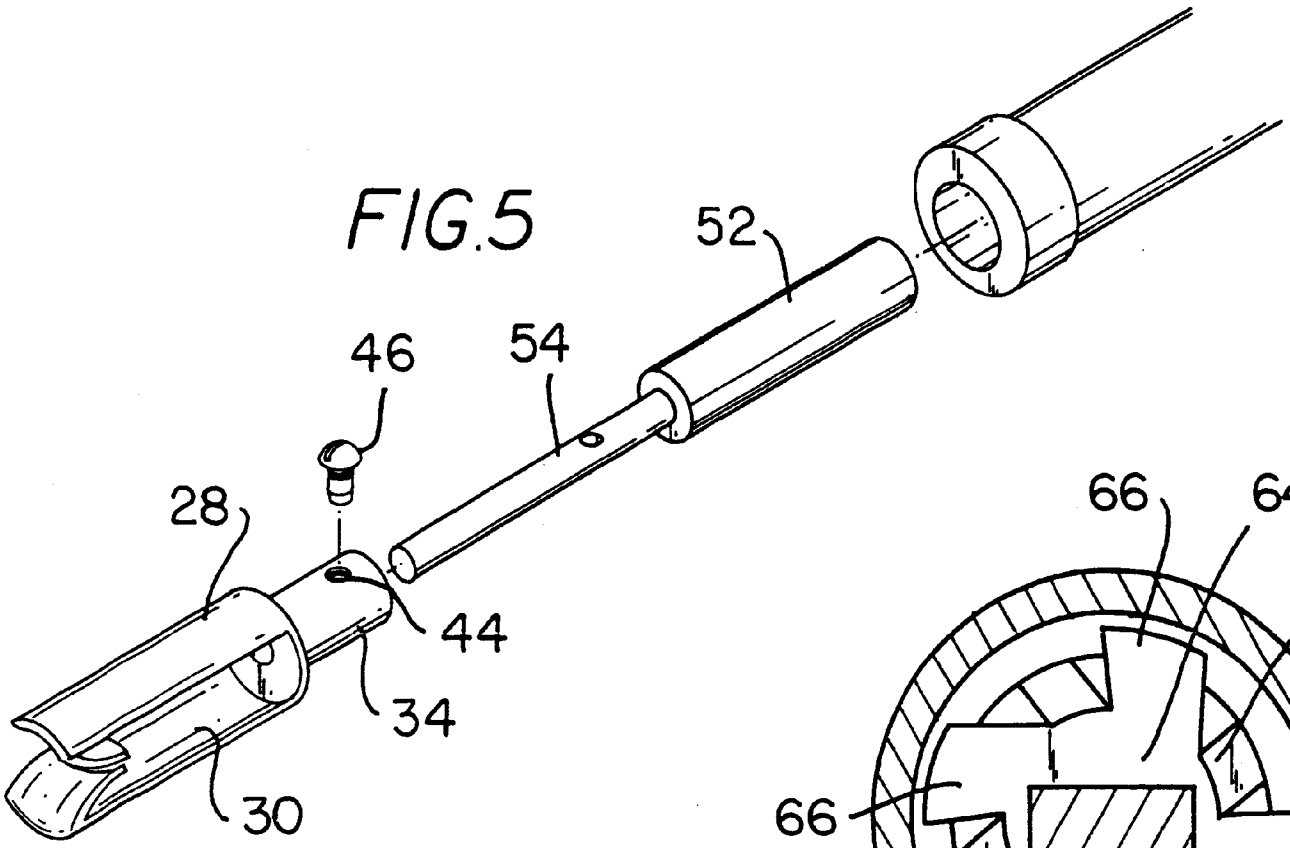
FIG. 5 is a expanded view of the present invention.
Figure 6:
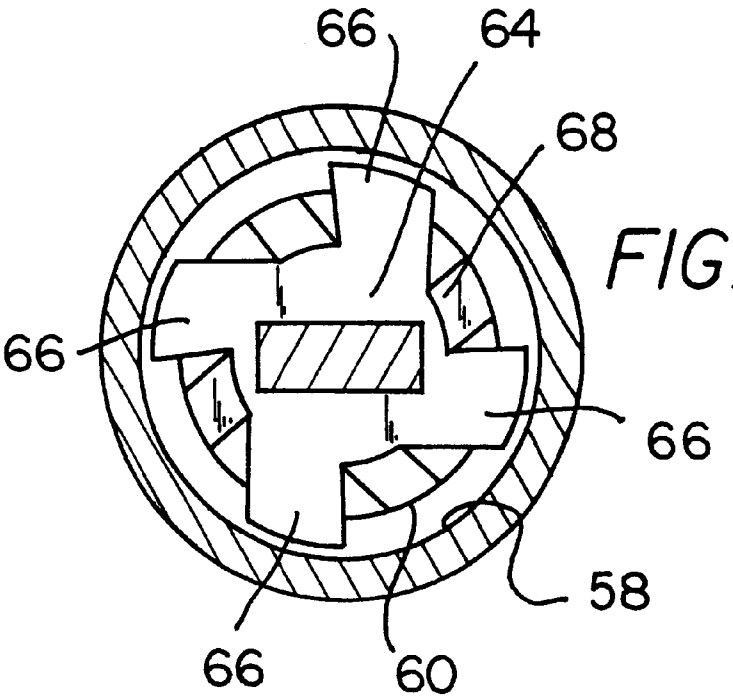
FIG. 6 is a end view of the present invention.
Figure 8:
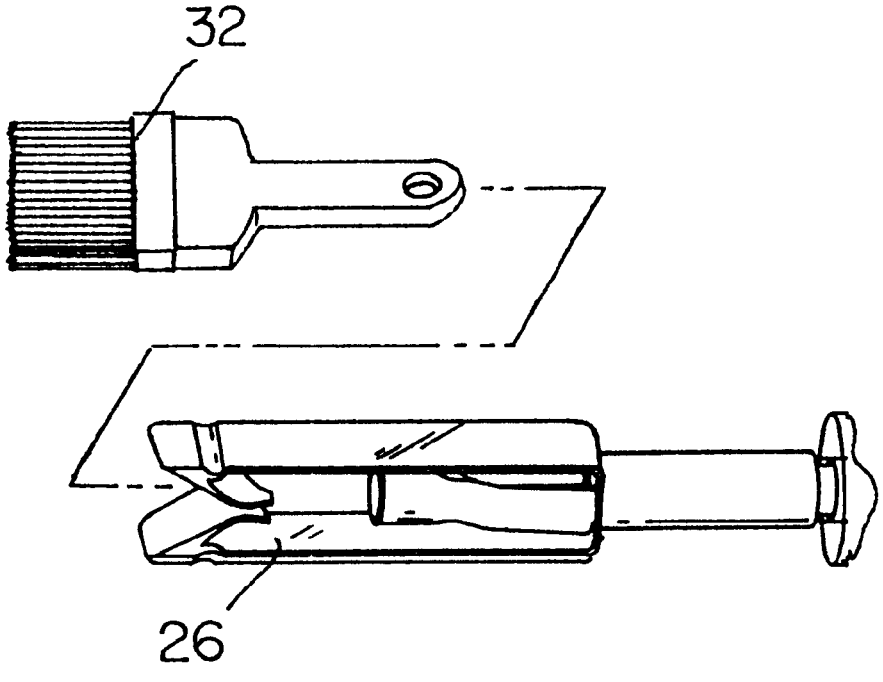
FIG. 8 is a side view of the present invention.
Figure 9:
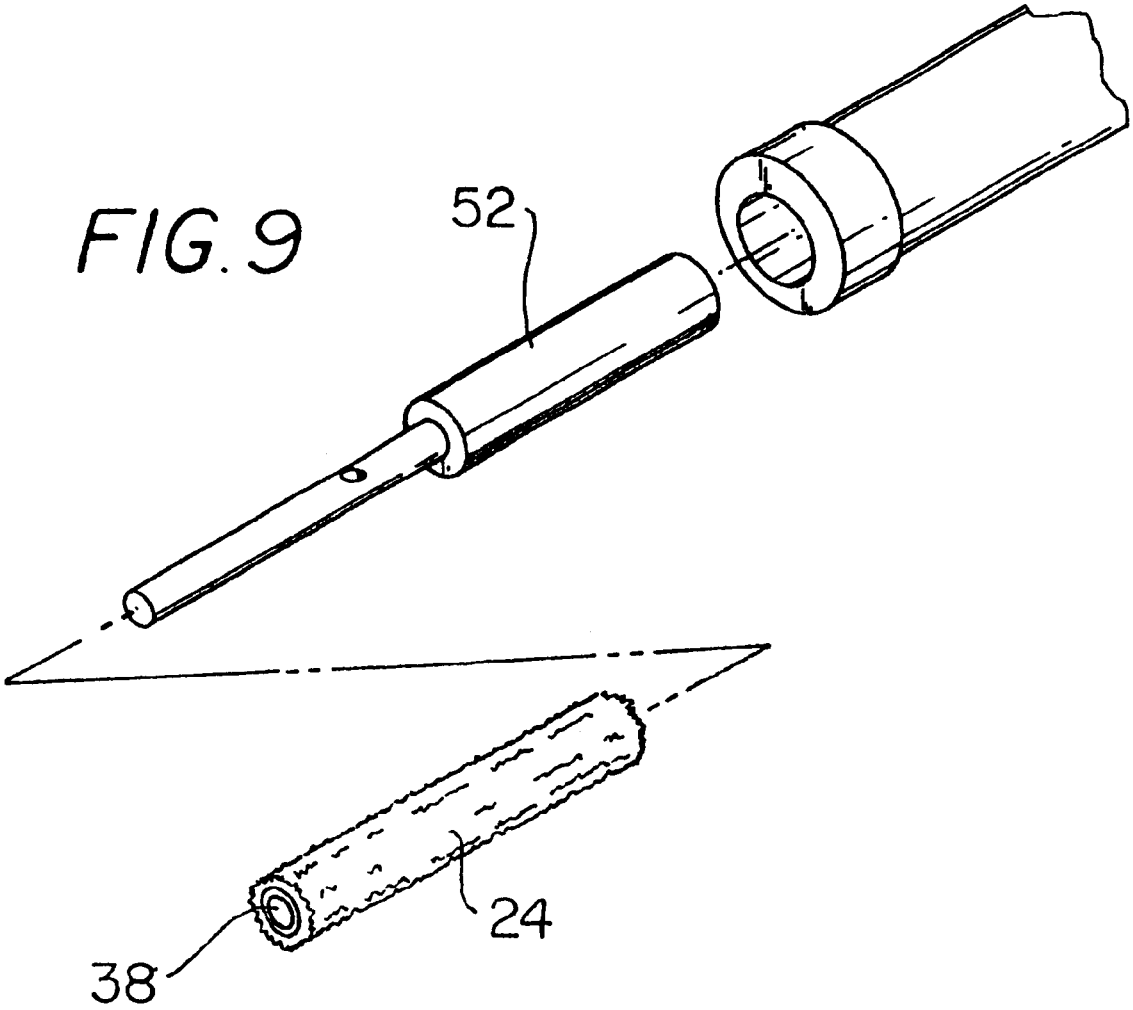
FIG. 9 is an expanded view of the present invention.
Figure 10:
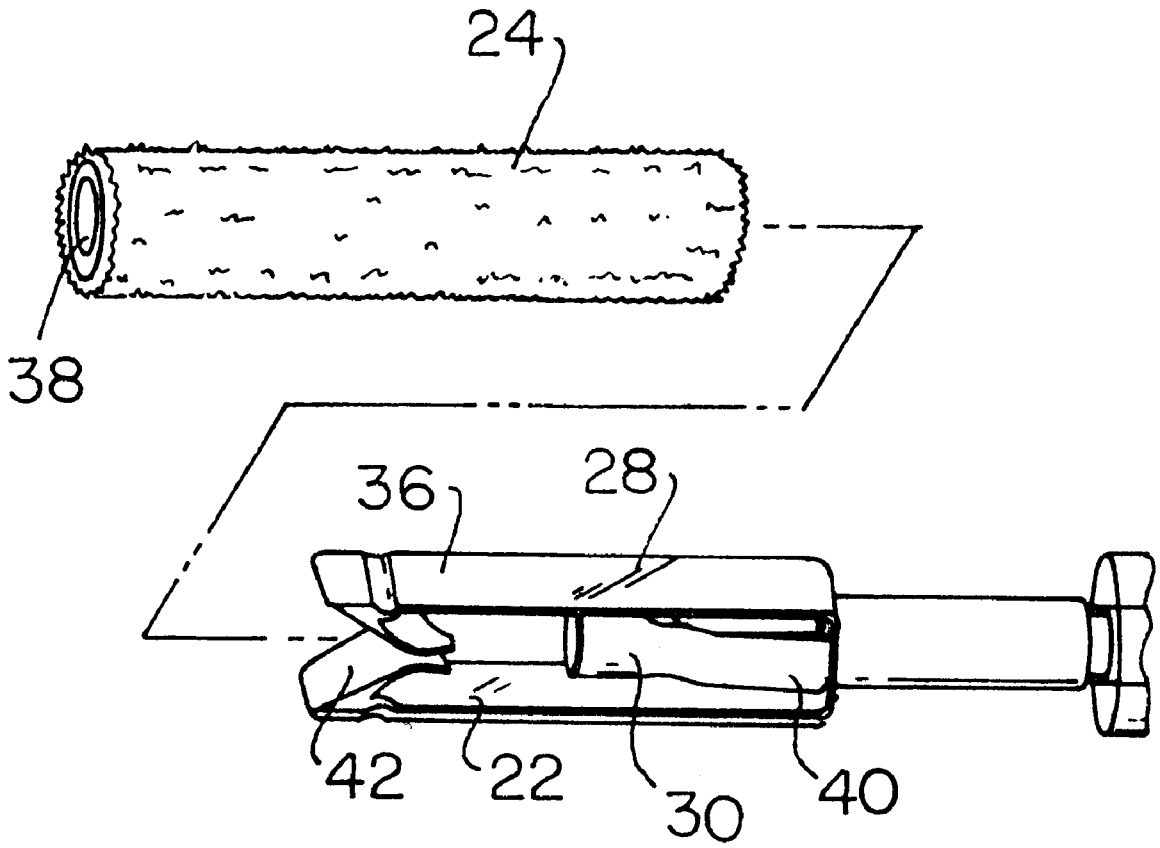
FIG. 10 is a side view of the present invention.

With reference now to the drawings, and in particular to FIGS. 1 through 10 thereof, a new paint applicator cleaning apparatus embodying the principles and concepts of the present invention and generally designated by the reference numeral 10 will be described.

As best illustrated in FIGS. 1 through 10, the paint applicator cleaning apparatus 10 generally comprises a housing 12 which includes an outer shaft 14 and an inner shaft 16. The inner shaft 16 is rotatably coupled to the outer shaft 14, the outer shaft 14 is designed for being gripped by a user.

A drive assembly 18 is slidably inserted through the inner shaft 16 of the housing 12 such that longitudinal movement of the drive assembly 18 rotates the inner shaft 16. The drive assembly 18 includes a handle 20 that extends from the housing 12. The handle is designed for facilitating gripping of the drive assembly 18 by a hand of the user.

A first adapter assembly 22 is slidably coupled to the inner shaft 16 of the housing 12, the first adapter 22 is designed for removably receiving a elongated roller cover 24. The first adapter assembly 22 is rotated when the inner shaft 16 is rotated by the drive assembly 18 whereby the elongated roller cover 24 is spun and the water is forced out the elongated roller cover 24.

A second adapter assembly 26 includes a first applicator member 28 and a second applicator member 30. The second adapter assembly 26 is removably coupled to the first adapter assembly 22 such that rotation of the first adapter 22 rotates the second adapter 26. The second adapter assembly 26 is adapted to receive a paint brush 32 and a roller cover 24 whereby the paint brush 32 and roller cover 24 are spun to force water out of the paint brush 32 and the roller cover 24.

The second adapter assembly 26 has a coupling sleeve 34 that is coupled to the first applicator member 28 and the second applicator member 30. The coupling sleeve 34 is slidably couplable to the first adapter assembly 22.

The first applicator member 28 has a pair of outer arms 36 adapted to removably receive an inner core 38 of the roller cover 24. The outer arms 36 are coupled to a perimeter of an end of the coupling sleeve 34. The pair of outer arms 36 is diametrically opposed along the perimeter of the end of the coupling sleeve 34. The inner arms 40 are aligned perpendicularly to the outer arms 36, the outer arms 36 each include an associated finger 42 that backwardly extend from a free end of the respective outer arm 36. Each finger 42 is adapted to removably receive an edge of the handle of the paintbrush 32.

The second adapter assembly 26 includes a locking aperture 44 through the coupling sleeve 34 of the second adapter assembly 26. A locking screw 46 is engaged to a secure an aperture 44 of the first adapter assembly 22 when the locking screw 46 is inserted through the locking aperture 44 whereby the second adapter assembly 26 is secured to the first adapter assembly 22. The locking screw 46 has a head 48 and shank 50, the shank 50 includes a threaded portion for engaging the locking aperture 44 of the second adapter assembly 26, the threaded portion of the shank 50 is positioned proximate the head 48 of the locking screw 46.

The first adapter assembly 22 has an upper shaft 52 and a lower shaft 54, the upper shaft 52 is removably inserted into the inner shaft 16 of the housing 12. The lower shaft 54 extends outwardly from an end of the upper shaft 52, the lower shaft 54 is adapted for removably receiving the elongated roller cover 24. The upper shaft 52 has a diameter greater than a diameter of the lower shaft 54 such that the upper shaft 52 is adapted to be aligned to the elongated roller cover 24 along a length of the lower shaft 54 when the elongated roller cover 24 abuts the upper shaft 52.

The housing 12 has a pair of bearings 56 coupled between the outer shaft 14 and the inner shaft 16, an outer race 58 of each of the bearings 56 is coupled to the outer shaft 14 of the housing 12. An inner race 60 of each of the bearings 56 is coupled to the inner shaft 16 such that the inner shaft 16 rotates in relation to the outer shaft 14.

The drive assembly 18 has a helical bar 62 coupled to an end of the handle 20, the helical bar 62 includes counter-clockwise twist. A transmission plate 64 is slidably coupled to the helical bar 62 such that longitudinal movement of the helical bar 62 rotates the transmission plate 64. The transmission plate 64 is for engaging a top end of the inner shaft 16 of the housing 12 whereby rotation of the transmission plate 64 rotates the inner shaft 16 of the housing 12.

A plurality of arms 66 extends outwardly from an outer periphery of the transmission plate 64 The top end of the inner shaft 16 includes a plurality of tines 68 that upwardly extend from the inner shaft 16 such that the tines 68 of the inner shaft 16 are positioned for engaging the arms 66 of the transmission plate 64. The arms 66 of the transmission plate 64 are for transmitting rotational force of the transmission plate 64 to the tines 68 of the inner shaft 16 of the housing 12.

In use, a user would install the desired adapter assembly and couple the desired painting tool to be cleaned to the adapter assembly. The user then would pull up and down on the handle of the present invention cleaning the paint tool and spinning it dry.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paint applicator cleaning apparatus for removing excess water from a paint applicator, said apparatus comprising:

a housing includes an outer shaft and an inner shaft, said inner shaft being rotatably coupled to said outer shaft, said outer shaft being adapted for being gripped by a user;

a drive assembly being slidably inserted through said inner shaft of said housing such that longitudinal movement of said drive assembly rotates said inner shaft, said drive assembly includes a handle extending from said housing, said handle being adapted for facilitating gripping of said drive assembly by a hand of the user;

a first adapter assembly being slidably coupled to said inner shaft of said housing, said first adapter being adapted for removably receiving a elongated roller cover, said first adapter assembly being rotated when said inner shaft is rotated by said drive assembly whereby the elongated roller cover is spun and the water is forced out the elongated roller cover; and a second adapter assembly includes a first applicator member and a second applicator member, said second adapter assembly being removably coupled to said first adapter assembly such that rotation of said first adapter rotates said second adapter, said second adapter assembly being adapted for receiving a paint brush and a roller cover whereby the paint brush and roller cover are spun to force water out of the paint brush and the roller cover.

2. The apparatus as set forth in claim 1, wherein said second adapter assembly has a coupling sleeve being coupled to said first applicator member and said second applicator member, said coupling sleeve being slidably couplable to said first adapter assembly.

3. The apparatus as set forth in claim 2, wherein said first applicator member has a pair of outer arms adapted for removably receiving an inner core of the roller cover, said outer arms being coupled to a perimeter of an end of said coupling sleeve, said pair of outer arms being diametrically opposed along said perimeter of said end of said coupling sleeve.

4. The apparatus as set forth in claim 3, wherein said second applicator member has a pair of inner arms adapted for removably receiving a handle of the brush, said inner arms each includes a connector portion and a engaging portion, said connector portion of each of said inner arms being coupled to an interior of said end of said coupling sleeve, said engaging portion of each of said inner arms being coupled to a free end of said respective connector portion, said engaging portion being adapted for securely engaging a side of the handle of the paint brush.

5. The apparatus as set forth in claim 4, wherein said inner arms are aligned perpendicularly to said outer arms, said outer arms each includes an associated finger backwardly extending from a free end of said respective outer arm, each said finger being adapted for removably receiving an edge of the handle of the paint brush.

6. The apparatus as set forth in claim 2, further comprising:

said second adapter assembly including a locking aperture through said coupling sleeve of said second adapter assembly; and a locking screw engagable to a securing aperture of said first adapter assembly when said locking screw is inserted through said locking aperture whereby said second adapter assembly is secured to said first adapter assembly.

7. The apparatus as set forth in claim 6, wherein said locking screw has a head and shank, said shank includes a threaded portion for engaging said locking aperture of said second adapter assembly, said threaded portion of said shank being positioned proximate said head of said locking screw.

8. The apparatus as set forth in claim 1, wherein said first adapter assembly has an upper shaft and a lower shaft, said upper shaft being removably inserted into said inner shaft of said housing, said lower shaft extending outwardly from an end of said upper shaft, said lower shaft being adapted for removably receiving the elongated roller cover.

9. The apparatus as set forth in claim 8, wherein said upper shaft has a diameter greater than a diameter of said lower shaft such that said upper shaft is adapted for aligning the elongated roller cover along a length of said lower shaft when the elongated roller cover abuts said upper shaft.

10. The apparatus as set forth in claim 1, wherein said housing has a pair of bearings coupled between said outer shaft and said inner shaft, an outer race of each of said bearings being coupled to said outer shaft of said housing, an inner race of each of said bearings being coupled to said inner shaft such that said inner shaft rotates in relation to said outer shaft.

11. The apparatus as set forth in claim 1, further comprising:

said drive assembly has a helical bar coupled to an end of said handle; and a transmission plate being slidably coupled to said helical bar such that longitudinal movement of said helical bar rotates said transmission plate, said transmission plate being for engaging a top end of said inner shaft of said housing whereby rotation of said transmission plate rotates said inner shaft of said housing.

12. The apparatus as set forth in claim 11, further comprising:

a plurality of arms extending outwardly from an outer periphery of said transmission plate, said top end of said inner shaft includes a plurality of tines upwardly extending from said inner shaft such that said tines of said inner shaft are positioned for engaging said arms of said transmission plate, said arms of said transmission plate being for transmitting rotational force of said transmission plate to said tines of said inner shaft of said housing.

13. The apparatus as set forth in claim 11, wherein said helical bar has counter-clockwise twist.

14. A paint applicator cleaning apparatus for removing excess water from a paint applicator, said apparatus comprising:

a housing includes an outer shaft and an inner shaft, said inner shaft being rotatably coupled to said outer shaft, said outer shaft being adapted for being gripped by a user;

a drive assembly being slidably inserted through said inner shaft of said housing such that longitudinal movement of said drive assembly rotates said inner shaft, said drive assembly includes a handle extending from said housing, said handle being adapted for facilitating gripping of said drive assembly by a hand of the user;

a first adapter assembly being slidably coupled to said inner shaft of said housing, said first adapter being adapted for removably receiving a elongated roller cover, said first adapter assembly being rotated when said inner shaft is rotated by said drive assembly whereby the elongated roller cover is spun and the water is forced out the elongated roller cover;

a second adapter assembly includes a first applicator member and a second applicator member, said second adapter assembly being removably coupled to said first adapter assembly such that rotation of said first adapter rotates said second adapter, said second adapter assembly being adapted for receiving a paint brush and a roller cover whereby the paint brush and roller cover are spun to force water out of the paint brush and the roller cover;

wherein said second adapter assembly has a coupling sleeve being coupled to said first applicator member and said second applicator member, said coupling sleeve being slidably couplable to said first adapter assembly;

wherein said first applicator member has a pair of outer arms adapted for removably receiving an inner core of the roller cover, said outer arms being coupled to a perimeter of an end of said coupling sleeve, said pair of outer arms being diametrically opposed along said perimeter of said end of said coupling sleeve;

wherein said inner arms are aligned perpendicularly to said outer arms, said outer arms each includes an associated finger backwardly extending from a free end of said respective outer arm, each said finger being adapted for removably receiving an edge of the handle of the paint brush;

said second adapter assembly including a locking aperture through said coupling sleeve of said second adapter assembly;

a locking screw engagable to a securing aperture of said first adapter assembly when said locking screw is inserted through said locking aperture whereby said second adapter assembly is secured to said first adapter assembly;

wherein said locking screw has a head and shank, said shank includes a threaded portion for engaging said locking aperture of said second adapter assembly, said threaded portion of said shank being positioned proximate said head of said locking screw;

wherein said first adapter assembly has an upper shaft and a lower shaft, said upper shaft being removably inserted into said inner shaft of said housing, said lower shaft extending outwardly from an end of said upper shaft, said lower shaft being adapted for removably receiving the elongated roller cover;

wherein said upper shaft has a diameter greater than a diameter of said lower shaft such that said upper shaft is adapted for aligning the elongated roller cover along a length of said lower shaft when the elongated roller cover abuts said upper shaft;

wherein said housing has a pair of bearings coupled between said outer shaft and said inner shaft, an outer race of each of said bearings being coupled to said outer shaft of said housing, an inner race of each of said bearings being coupled to said inner shaft such that said inner shaft rotates in relation to said outer shaft;

said drive assembly has a helical bar coupled to an end of said handle, said helical bar includes counter-clockwise twist;

a transmission plate being slidably coupled to said helical bar such that longitudinal movement of said helical bar rotates said transmission plate, said transmission plate being for engaging a top end of said inner shaft of said housing whereby rotation of said transmission plate rotates said inner shaft of said housing; and a plurality of arms extending outwardly from an outer periphery of said transmission plate, said top end of said inner shaft includes a plurality of tines upwardly extending from said inner shaft such that said tines of said inner shaft are positioned for engaging said arms of said transmission plate, said arms of said transmission plate being for transmitting rotational force of said transmission plate to said tines of said inner shaft of said housing.

* * * * *